US006308848B1

(12) United States Patent
Parrinello

(10) Patent No.: US 6,308,848 B1
(45) **Date of Patent: *Oct. 30, 2001**

(54) PLASTIC SCREW CAP WITH TAMPER-EVIDENT RING

(75) Inventor: Fiorenzo Parrinello, Medicina (IT)

(73) Assignee: Sacmi Cooperativa Meccanici Imola S.c.r.l., Imola (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/140,455

(22) Filed: Aug. 26, 1998

(30) Foreign Application Priority Data

May 8, 1998 (IT) ..... BO98A0296

(51) Int. Cl.[7] ..... B65D 41/34
(52) U.S. Cl. ..... 215/252
(58) Field of Search ..... 215/252, 258

(56) References Cited

U.S. PATENT DOCUMENTS

| | | | | |
|---|---|---|---|---|
| 4,485,934 | * | 12/1984 | Maguire | 215/252 |
| 5,131,550 | * | 7/1992 | Thompson | 215/252 |
| 5,356,019 | * | 10/1994 | Kelly | 215/252 |
| 5,413,235 | * | 5/1995 | Decelles | 215/252 |
| 5,564,582 | * | 10/1996 | Kamath | 215/252 |
| 5,611,446 | * | 3/1997 | Ingram et al. | 215/252 |
| 5,660,289 | | 8/1997 | Spatz et al. . | |
| 5,680,945 | * | 10/1997 | Sander et al. | 215/252 |
| 5,779,075 | * | 7/1998 | Salmon et al. | 215/252 |
| 5,860,542 | * | 1/1999 | Takamatsu | 215/252 X |
| 5,992,661 | * | 11/1999 | Zumbuhl | 215/252 |

FOREIGN PATENT DOCUMENTS

| | | | |
|---|---|---|---|
| 37 23 235 | | 1/1989 | (DE) . |
| 0 460 557 | | 12/1991 | (EP) . |
| 0 573 138 | | 8/1993 | (EP) . |
| 0 688 724 | | 12/1995 | (EP) . |
| 2 744 988 | | 8/1997 | (FR) . |
| 64-84855 | * | 3/1989 | (JP) 215/252 |

* cited by examiner

*Primary Examiner*—Nathan J. Newhouse
(74) *Attorney, Agent, or Firm*—Guido Modiano; Albert Josif; Daniel O'Byrne

(57) ABSTRACT

A plastic screw cap includes a cylindrical cup provided with an internal thread and with a tamper-evident ring which is coupled to the rim of the cup by means of a plurality of bridges forming a fracture line; the ring has a collar or expansion for retaining it below an annular raised portion of a container whereto the cap is applied. Incisions are formed on the outside of the tamper-evident ring, the incisions do not cross the entire thickness of the ring and allow an elastic radial expansion of the ring, such as to pass beyond the annular raised portion during the application of the cap to the container.

17 Claims, 4 Drawing Sheets

PLASTIC SCREW CAP WITH TAMPER-EVIDENT RING

BACKGROUND OF THE INVENTION

The present invention relates to a plastic screw cap with tamper-evident ring.

Caps of the above type are already known commercially and comprise a cylindrical cup which is internally threaded in order to be screwed onto the top of the container (bottle).

A so-called tamper-evident ring is coupled to the rim of the cup by means of breakable bridges and is internally provided with engagement elements constituted by flaps or by a collar which, when the cap is applied so as to close the container, engage under an annular raised retention portion of the container. By unscrewing the cap, the flaps or the collar abut against the annular raised portion and retain the ring, while the resulting axial traction force breaks the bridges.

Conventional caps entail the problem of ensuring that during application to the container the flaps or collar can widen or otherwise be elastically deformed in order to pass over the raised retention portion of the bottle and then close again below said raised portion, so as to allow the separation of the tamper-evident ring during the unscrewing of the cap and clearly indicate that the container has been opened.

However, in currently commercially available caps the tamper-evident ring, in order to ensure that the teeth or collar remain engaged below the annular raised portion of the container during unscrewing and can thus ensure the breaking of the bridges, has an excessively rigid structure and therefore passing over the raised portion when the cap is applied to the container is critical.

SUMMARY OF THE INVENTION

The aim of the present invention is to provide a plastic cap which is capable of substantially obviating the shortcomings of conventional caps.

This aim is achieved by a plastic screw cap of the type composed of a cylindrical cup provided with an internal thread and with a tamper-evident ring which is coupled to the rim of the cup by means of a plurality of bridges forming a fracture line, said ring having a retention means for retaining it below an annular raised portion of a container whereto the cap is applied, incisions being formed on the outside of said tamper-evident ring, said incisions do not cross the entire thickness of the ring and allow an elastic radial expansion of the ring, such as to pass beyond said annular raised portion during the application of the cap to the container.

BRIEF DESCRIPTION OF THE DRAWINGS

Further characteristics and advantages of the present invention will become apparent from the following detailed description, on the basis of the accompanying drawings, wherein.

DESCRIPTION OF THE PREFERRED EMBODIMENTS

Figure 3:
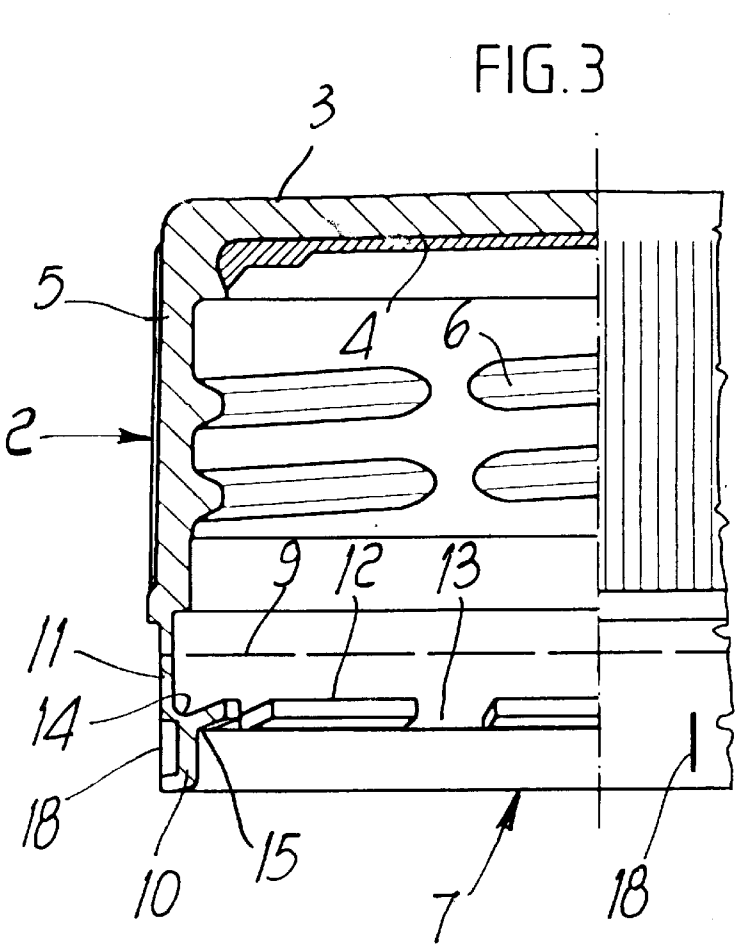
FIG. 3 is an enlarged-scale view of a detail of FIG. 2.
Figure 1:
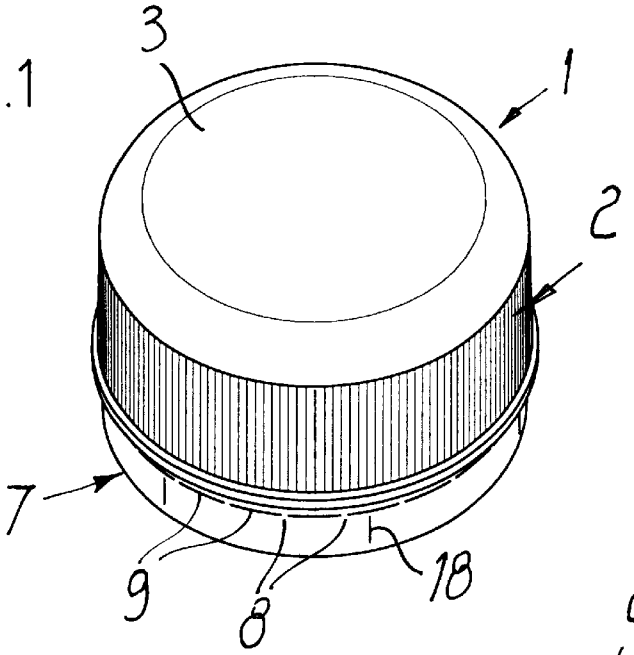
FIG. 1 is a perspective view of a cap provided with a tamper-evident ring, whose outside diameter is smaller than the diameter of the cup, and with an internal annular expansion provided with retention flaps.
Figure 2:
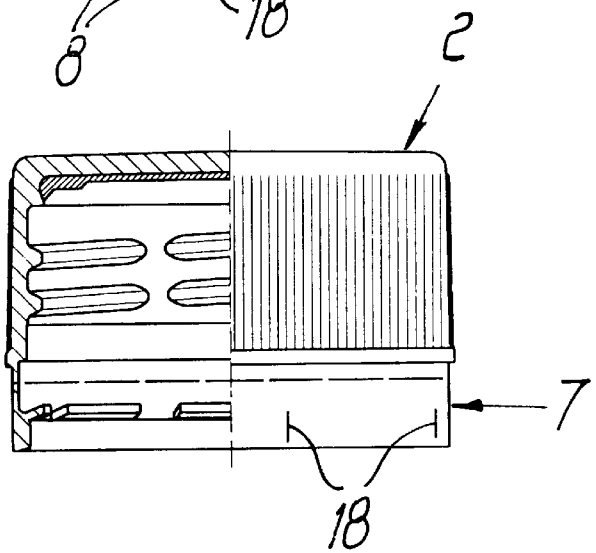
FIG. 2 is a partially sectional view, taken along an axial plane, of the screw cap of FIG. 1.

With reference to FIGS. 1, 2 and 3, the reference numeral 1 generally designates a cap according to the present invention, formed by molding plastics according to conventional methods. The cap 1 comprises a cylindrical cup 2 which is composed of a bottom 3, which is internally covered by a liner 4, and of a cylindrical wall 5 inside which a thread 6 is formed.

A tamper-evident ring 7 protrudes from the rim of the cylindrical wall 5 of the cup 2 and is composed of a cylindrical wall whose rim is connected to the rim of the cup 2 by means of a plurality of bridges 8 which are spaced by slits 9. The bridges 8 and the slits 9 form a fracture line which allows to separate the tamper-evident ring 7 from the cup 2 when the cap is unscrewed from the container whereto it has been applied.

The opposite rim of the ring 7 is internally provided with an annular expansion 10, whose inside diameter is substantially equal to the inside diameter of the wall 5. The bridges 8 and the slits 9 can be provided in any manner, for example during the molding of the cap by providing suitable mold shapes or by means of cutting operations performed after molding.

A connecting region is formed between the rim of the cup 2 and the expansion 10 and is constituted by a wall 11 whose outside diameter is smaller than the outside diameter of the wall 5 and whose inside diameter is greater than the inside diameter of the expansion 10, so that the wall 11 is significantly thinner than the wall 5 of the cup. This difference in thickness allows the wall 11, by exploiting the elasticity of the plastics material, to follow any widening occurring during the application of the cap to a container and to assume a conical shape which tapers toward the bottom 3 of the cup 2, as occurs for example during application to a container.

From the above description it is thus evident that the expansion 10 is significantly thicker than the wall 11 and protrudes from the inner face thereof, so that the inside diameter of the expansion 10 is significantly smaller than the inside diameter of the wall 11.

The greater thickness of the annular expansion 10 ensures that said expansion has, in relation to the elasticity of the plastics material the cap is made of, a reduced ability to widen with respect to the wall 11.

The difference in inside diameter between the expansion 10 and the wall 11 forms a steplike connecting region, wherefrom multiple flaps 12 protrude toward the inside of the cup 2; said flaps are inclined toward the bottom 3 of the cup at a preset angle. The flaps 12 are equidistant and mutually separated by spaces 13 and their thickness is preferably greater than the thickness of the wall 11 but smaller than the thickness of the expansion 10. Moreover, the upper and lower faces of the flaps 12 are connected to the internal faces of the wall 11 and of the expansion 10 by radiused regions 14 and 15.

Figure 4:
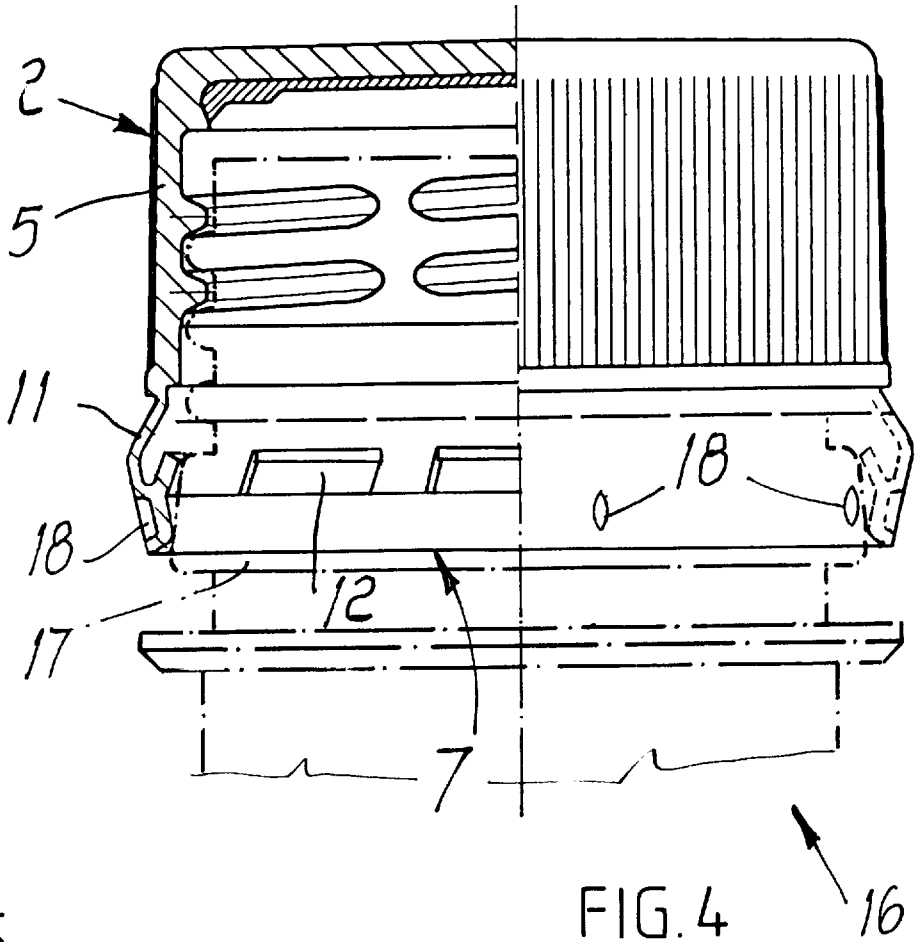
FIG. 4 is a partially sectional view, taken along an axial plane, of the cap in the position for application to a container.

The different thickness of the wall 11, of the expansion 10 and of the flaps 12 causes on the one hand easier application of the cap to a container 16 (shown in dashed lines in FIG. 4) and, on the other hand, firmer retention of the tamper-evident ring 7 below the annular raised portion 17 of the container 16 whereto the cap 1 is applied and, ultimately, safer separation thereof when the cap is unscrewed.

However, the greater thickness of the annular expansion 10 constitutes a considerable critical point in the application of the cap to the container. Indeed, when applying the cap, due to the lower elasticity of the expansion 10 the contrast to the widening of the thinner region of the wall 11 which is close to the expansion 10 can cause the bridges 8 to break.

According to an important aspect of the present invention, this drawback can be obviated with surprisingly positive results by providing a plurality of incisions 18 which are distributed along the outer peripheral region of the tamper-evident ring 7 and affect the region of the expansion 10. Said incisions 18 have an axial orientation and do not pass through the thickness of the expansion. In this manner, when the cap is applied to the container 16, the radial expansion of the tamper-evident ring 7 is facilitated by the opening of the score lines 18 in a circumferential direction (see FIG. 4), which by entailing an increase in the diameter of the expansion allow the tamper-evident ring 7 to slide above the annular raised portion 17 of the container below which it must engage.

It should be observed that since the incisions 18 are not through cuts, they do not compromise the strength of the expansion 10 and therefore the engagement of the flaps 12 below the annular raised portion 17 of the container.

The number of the incisions 18 is chosen as a function of the greater flexibility to be given to the tamper-evident ring 7.

It should be observed that the ability of the tamper-evident ring 7 to expand radially is limited so that the tamper-protection of the container is not compromised. Moreover, the greater flexibility of the tamper-evident ring and the reduced stresses whereto the bridges 8 are subjected during the application of the cap allow to reduce the thickness of the bridges and therefore to facilitate their breakage when the cap is unscrewed.

In its practical embodiment, the cap according to the present invention is susceptible of numerous modifications and variations, all of which are within the scope of the same inventive concept.

Figure 5:
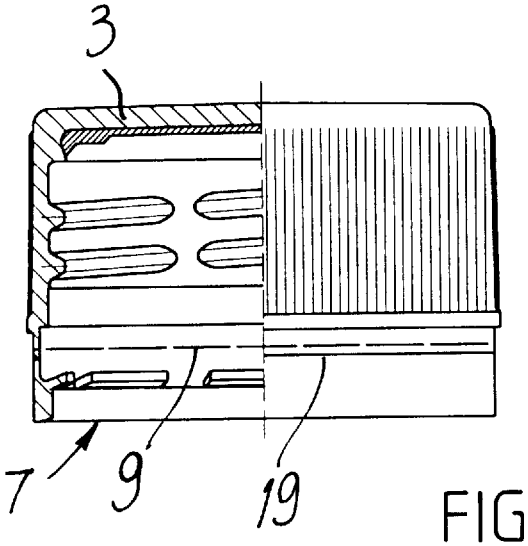
FIG. 5 is a partially sectional view, taken along an axial plane, of a variation of the cap.
Figure 6:
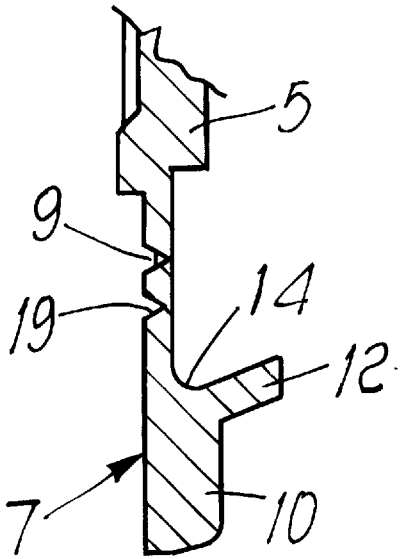
FIG. 6 is an enlarged-scale view of the cross-section of the tamper-evident ring of the cap of FIG. 5.
Figure 8:
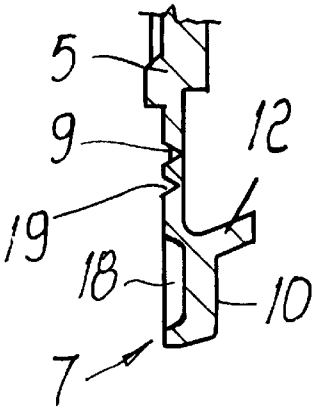
FIG. 8 is an enlarged-scale view of the cross-section of the tamper-evident ring of the cap of FIG. 7.
Figure 7:
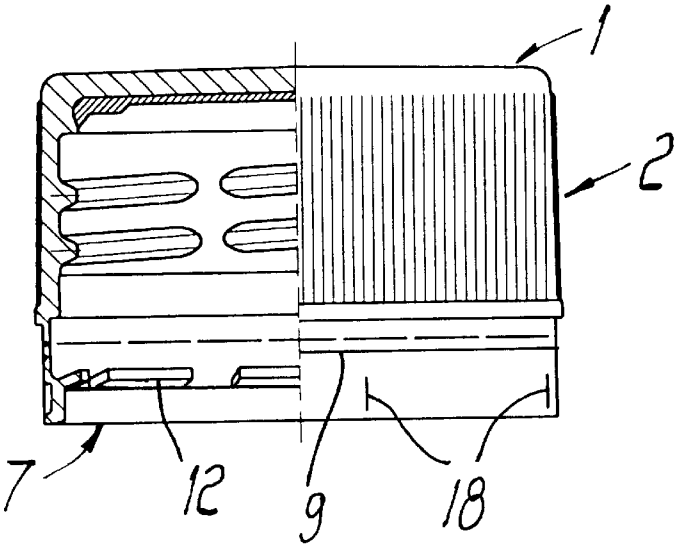
FIG. 7 is a partially sectional view of another variation of the cap.

FIGS. 5 and 6 are views of an embodiment in which instead of the axial incisions a circumferential incision 19 is provided in the outer face of the wall 11, arranged between the fracture line formed by the slits 9 and the expansion 10. It is of course possible to combine axial incisions 18 with a circumferential incision 19, as provided in the embodiment of FIGS. 7 and 8. In particular, it should be observed that the axial incisions can partially extend into the wall 11 as well and join the circumferential incision 19.

Figure 10:
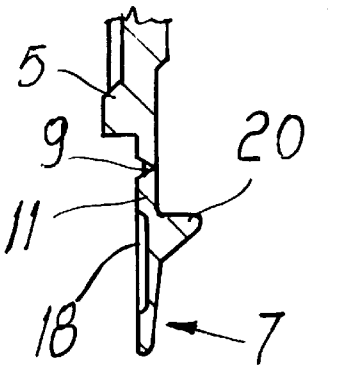
FIG. 10 is an enlarged-scale view of the cross-section of the tamper-evident ring of the cap of FIG. 9.
Figure 11:
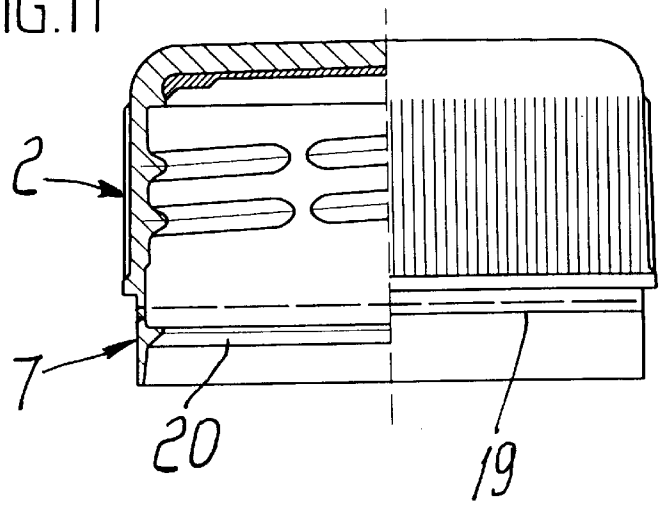
FIGS. 11 and 12 are partially sectional views, taken along an axial plane, of the cap according to two further variations.
Figure 9:
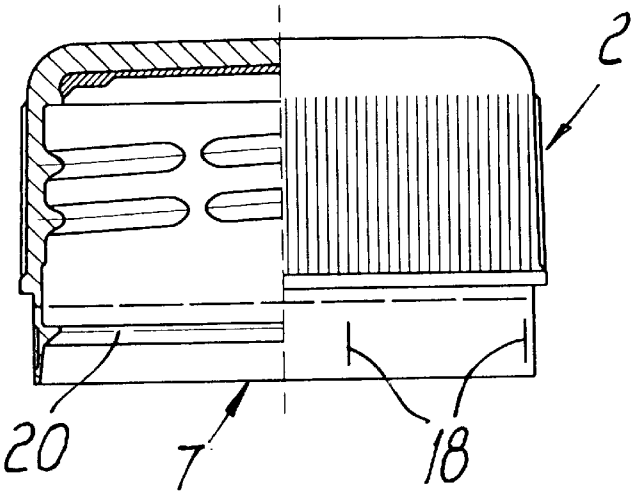
FIG. 9 is a partially sectional view of another variation of the cap.
Figure 13:
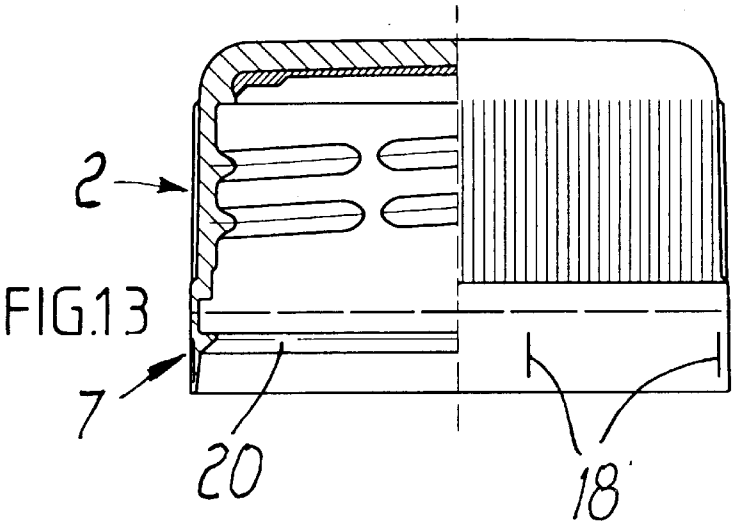
FIGS. 13 to 15 are partially sectional views, taken along an axial plane, of three variations of a cap provided with a tamper-evident ring, whose outside diameter is equal to the outside diameter of the cup, and with an internal retention collar.
Figure 15:
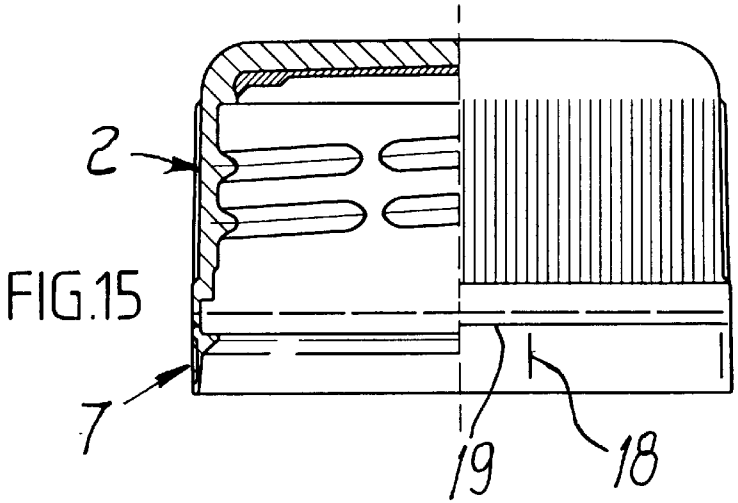
Figure 12:
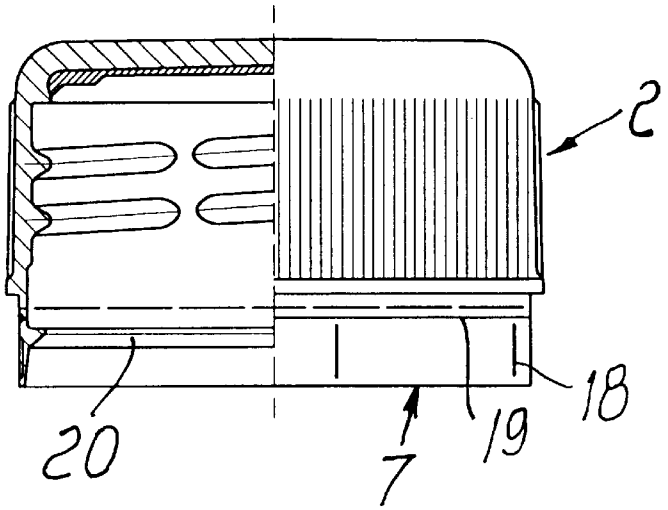
Figure 14:
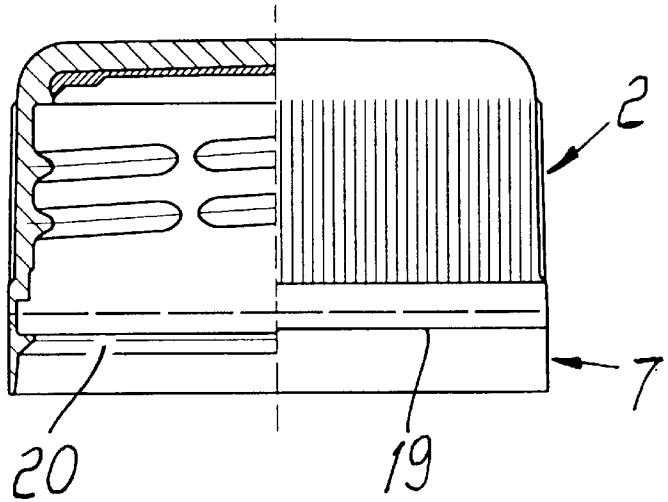

FIGS. 9, 11 and 12 relate to the application of the inventive concept to a cap in which the tamper-evident ring 7 is not provided with the annular expansion 10 and retention of the cap on the container is achieved with a continuous internal collar 20 instead of with flaps 12. Advantageously, the axial incisions 18, as shown in FIG. 10, affect the region of the collar 20 and continue into the wall 11. FIGS. 13 to 15 illustrate a cap according to still a further aspect of the invention, wherein the tamper-evident ring has an outside diameter which is equal to that of the cup 2. In this case also, the axial incisions 18 can continue into the wall 11. In the practical embodiment of the invention, the incisions 18, 19 can be formed during molding. However, said incisions are preferably formed by means of a cutting machine provided with a blade which allows to precisely adjust the depth of the incisions.

The disclosures in Italian Patent Application No. BO98A000296 from which this application claims priority are incorporated herein by reference.

What is claimed is:

1. A plastic screw cap comprising a cylindrical cup provided with an internal thread and with a tamper-evident ring which is coupled to the rim of the cup by means of a plurality of bridges forming a fracture line, said ring having a retention means for retaining it below an annular raised portion of a container whereto the cap is applied, incisions being formed by means of a cutting machine provided with a blade on the outside of said tamper-evident ring, said incisions being configured such as not to cross the entire thickness of the ring and to allow an outwardly directed elastic radial expansion of the ring with a simultaneous inwardly directed bending of the bottom of the ring such as to permit the ring to pass beyond said annular raised portion during the application of the cap to the container, said incisions comprising axial incisions, which are distributed circumferentially on the outside of said tamper-evident ring, and a circumferential incision which extends on an outer face of said tamper-evident ring circumferentially between the fracture line and the free rim of the tamper-evident ring.

2. The cap according to claim 1, wherein said retention means comprises an annular expansion which is formed inside said tamper-evident ring and has a plurality of substantially rigid flaps which protrude inward and toward the bottom of said cup and are adapted to engage below said raised portion of said container.

3. The cap according to claim 2, wherein said axial incisions are formed at said expansion.

4. The cap according to claim 3, wherein said circumferential incision is arranged in the region of said tamper-evident ring which lies between said expansion and said fracture line.

5. The cap according to claim 1, wherein said retention means comprises a collar which lies inside said tamper-evident ring and is adapted to engage below said raised portion of said container.

6. The cap according to claim 5, wherein said axial incisions are formed at said collar.

7. The cap according to claim 6, wherein said circumferential incision is arranged in the region of said tamper-evident ring which lies between said collar and said fracture line.

8. The cap according to claim 1, wherein the outside diameter of said tamper-evident ring is smaller than the outside diameter of said cup.

9. A plastic screw cap comprising a cylindrical cup provided with an internal thread and with a tamper-evident ring which is coupled to the rim of the cup by means of a plurality of bridges forming a fracture line, said ring having an annular expansion for retaining it below an annular raised portion of a container whereto the cap is applied, and an annular wall between said annular expansion and said fracture line, said annular wall being thinner than said annular expansion, a circumferential incision being formed by means of a cutting machine provided with a blade on the outside of said annular wall, said circumferential incision being configured such as not to cross the entire thickness of said annular wall and to allow an outwardly directed elastic radial expansion of said annular wall with a simultaneous inwardly directed bending of the bottom of the ring such as to permit the annular expansion to pass beyond said annular raised portion during the application of the cap to the container.

10. The cap according to claim 9, further comprising axial incisions which are distributed circumferentially on the outside of said annular expansion.

11. The cap according to claim 10, wherein said axial incisions do not cross the entire thickness of said annular expansion.

12. The cap according to claim 9, wherein said annular expansion is provided with a plurality of flaps which protrude inwardly and toward the bottom of said cup and are adapted to engage below said raised portion of said container.

13. The cap according to claim 9, wherein said annular wall has an inside diameter which is greater than the inside diameter of said annular expansion.

14. The cap according to claim 13, wherein said annular expansion has an inside diameter which is substantially equal to the inside diameter of said cup.

15. The cap according to claim 14, further comprising multiple flaps, mutually separated by spaces, protruding internally at a steplike connecting region between said annular expansion and said annular wall, said multiple flaps having a thickness which is greater than the thickness of said annular wall and smaller than the thickness of said annular expansion.

16. The cap according to claim 15, wherein said multiple flaps have upper and lower faces respectively connected to the internal faces of said annular wall and said annular expansion by radiused regions.

17. The cap according to claim 16, wherein said annular wall and said annular expansion have substantially the same outside diameter, which is smaller than the outside diameter of said cup.

* * * * *